US005733071A

United States Patent [19]

Shudo

[11] Patent Number: 5,733,071

[45] Date of Patent: Mar. 31, 1998

[54] RAMMER INCORPORATING AN INTERNAL COMBUSTION ENGINE HAVING AN INCLINED CYLINDER AXIS

[75] Inventor: Shigeru Shudo, Saitama-ken, Japan

[73] Assignee: Honda Giken Kogyo Kabushiki Kaisha, Tokyo, Japan

[21] Appl. No.: 616,137

[22] Filed: Mar. 14, 1996

[30] Foreign Application Priority Data

Mar. 20, 1995 [JP] Japan ..... 7-087620

[51] Int. Cl.[6] ..... E01C 19/35; E02D 3/02

[52] U.S. Cl. ..... 405/271; 404/133.1

[58] Field of Search ..... 405/271; 404/133.1; 173/118

[56] References Cited

U.S. PATENT DOCUMENTS

| | | | |
|---|---|---|---|
| 2,677,355 | 5/1954 | Maurer et al. | 404/133.1 X |
| 3,277,801 | 10/1966 | Horvath et al. | 404/133.1 |
| 3,832,081 | 8/1974 | Opderbeck et al. | 404/133 |
| 5,340,233 | 8/1994 | Motl | 404/133.1 |

FOREIGN PATENT DOCUMENTS

| | | |
|---|---|---|
| 63-104410 | 7/1988 | Japan . |
| 6-19601 | 5/1994 | Japan . |

*Primary Examiner*—Tamara L. Graysay
*Assistant Examiner*—Tara L. Mayo
*Attorney, Agent, or Firm*—Skjerven Morrill MacPherson Franklin & Friel; Thomas S. MacDonald

[57] ABSTRACT

In a rammer powered by an internal combustion engine, the engine is placed on a side of an upper part of a rammer main body with its crankshaft extending in parallel with the handle bar of the rammer, and the cylinder axis of the engine slanted sideways so that the overall height of the rammer may be controlled even when a relatively large engine is employed. The engine is mounted on the rammer main body so that the center of gravity of the engine is on the axial center line of the rammer main body as projected on a plane perpendicular to the crankshaft. Therefore, a relatively large engine can be used without destroying the balance of the rammer, and the rammer, therefore, would not produce any tendency to tilt during use. Thus, the rammer is easy and comfortable to handle even when a relatively large engine is mounted thereof.

2 Claims, 3 Drawing Sheets

RAMMER INCORPORATING AN INTERNAL COMBUSTION ENGINE HAVING AN INCLINED CYLINDER AXIS

TECHNICAL FIELD

The present invention relates to a rammer powered by an internal combustion engine which is typically used for compacting the ground surface, and in particular to such a rammer employing an internal combustion engine having an inclined cylinder axis.

BACKGROUND OF THE INVENTION

A rammer typically comprises a cylindrical main body which is normally held by the operator by a handle extending laterally from an upper end of the main body, a stamping plate provided at a lower end of the main body, and an internal combustion engine which is attached to the side of the main body facing the operator with its cylinder axis extending in parallel with the axial center of the main body, and with its crankshaft extending in parallel with the handle. The crankshaft of the engine is connected to the stamping plate via a power train so that the stamping plate may reciprocate in the axial direction with respect to the main body. The stamping plate applies a necessary stamping force to the ground surface by virtue of the reaction supported by the inertia of the main body. Japanese utility model laid-open publication (kokai) No. 63-104410 discloses a rammer employing such a vertically oriented engine whose output shaft extends laterally into the rammer main body.

Because the engine is located between the rammer main body and the operator, it is desired to have a low profile so that the overall height of the rammer may be kept within an acceptable size, and the view of the operator may not be obstructed by the engine. However, when the output power of the internal combustion engine is required to be increased, and the size of the engine is accordingly increased, it becomes increasingly difficult to limit the height of the rammer within the acceptable level. Japanese utility model publication (kooky) No. 6-19601 discloses a rammer employing a horizontally disposed engine whose output shaft extends vertically into the rammer main body. The output shaft of the engine is connected to a worm which meshes with a worm gear having a horizontal center line. This worm gear is connected to a stamping plate via a crank mechanism. This arrangement allows the engine to be mounted substantially on top of the rammer main body, and achieves a favorable balance during use. In other words, the rammer demonstrates a relatively small tendency to tilt. However, this arrangement is not effective in limiting the overall height of the rammer, and the improved balance may be offset by the increased height which tends to obstruct the view of the operator.

BRIEF SUMMARY OF THE INVENTION

In view of such problems of the prior art, a primary object of the present invention is to provide a rammer which has a limited vertical dimension even when a relatively large engine is used.

A second object of the present invention is to provide a rammer which is well balanced so that the operator would not experience any difficulty in operating it.

A third object of the present invention is to provide a rammer in which the distance between the rammer main body and the operator is not required to be unduly increased even when a relatively large engine is employed.

According to the present invention, these and other objects of the present invention can be accomplished by providing a rammer, comprising: a vertically elongated rammer main body having a stamping plate at a lower end thereof; a handle bar extending laterally from an upper part of said rammer main body; an internal combustion engine mounted on an upper part of said rammer main body substantially on a same side of thereof as said handle bar, a crankshaft of said engine extending substantially in parallel with said handle bar, and an axial center line of a cylinder of said engine being slanted sideways from a vertical axial line; and a power transmission unit mounted on said rammer main body for transmitting power of said engine to said stamping plate; wherein a center of gravity of said engine is placed substantially on a vertical line passing through a center of axial center line of said rammer main body as projected on a plane perpendicular to said handle bar.

Therefore, the vertical dimension of the engine can be favorably controlled, and a relatively large engine can be used without destroying the balance of the rammer. In other words, the rammer would not produce any substantial tendency to tilt during use. Thus, the rammer is easy and comfortable to handle even when a relatively large engine is mounted thereof.

Preferably, said power transmission unit comprises a power takeout shaft having an axial line which extends in parallel with said crankshaft and intersects with said vertical line, said power takeout shaft being connected to said stamping plate in a power transmitting relationship. For instance, a chain sprocket mechanism can be used for transmitting power from the crankshaft to the power takeout shaft.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
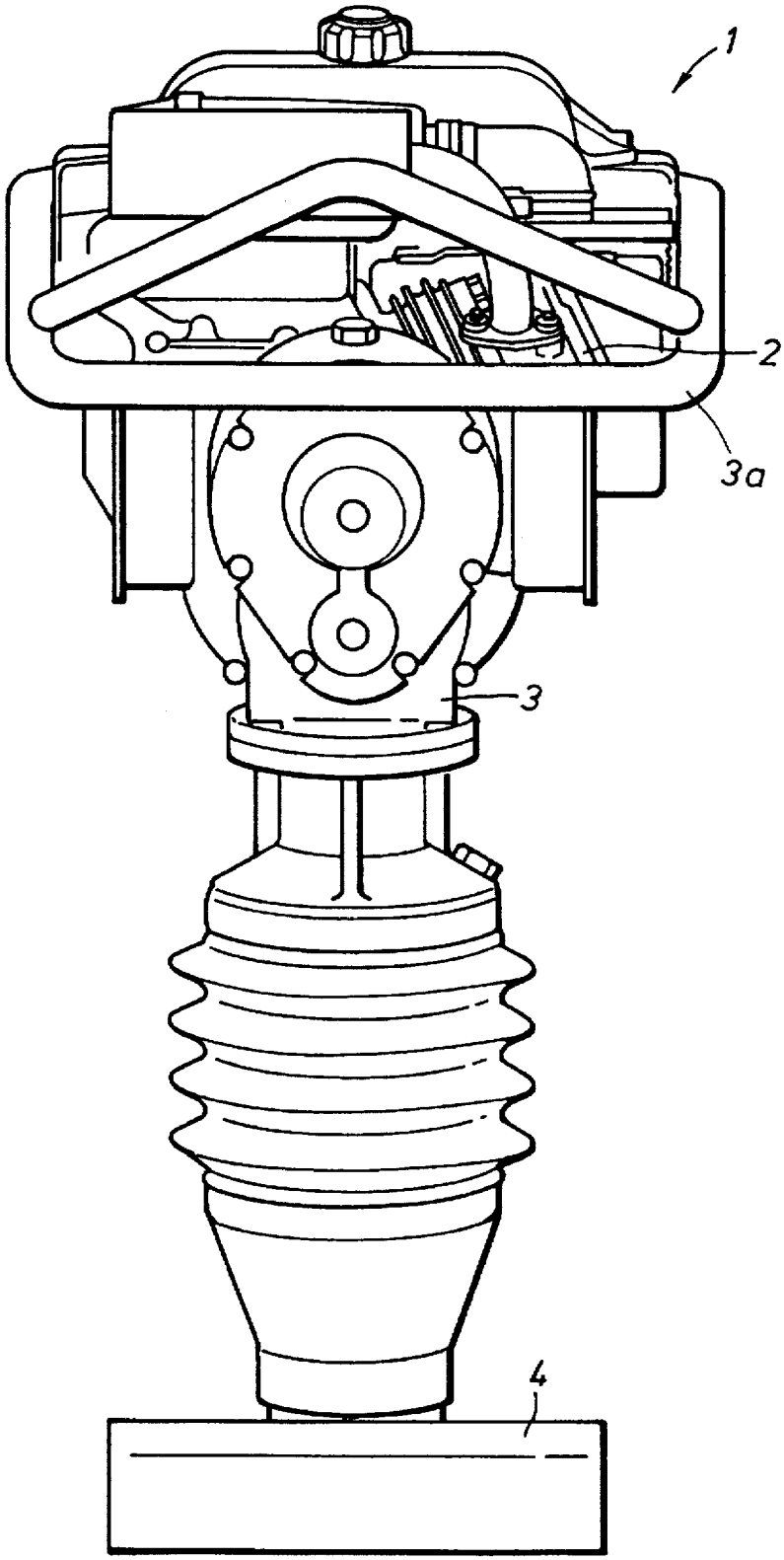
FIG. 1 is a front view of a preferred embodiment of the rammer according to the present invention as seen from the side of the operator.

Referring to FIG. 1, the rammer 1 according to the present invention comprises a vertically elongated rammer main body 3, a handle bar 3*a* extending laterally from an upper part of the rammer main body 3, an internal combustion engine 2 attached to an upper part of the rammer main body 3 on the same side thereof as the handle bar 3*a*, and a stamping plate 4 provided at a lower end of the rammer main body 3. The power produced from an output shaft of the engine 2 is transmitted to the stamping plate 4 via a power transmission unit which is described hereinafter so that the stamping plate 4 may reciprocate with respect to the rammer main body 3 in the axial direction. The internal combustion engine 2 is attached to the side of the rammer main body 3 facing the operator. Therefore, the internal combustion engine 2 is located between the rammer main body 3 and the operator.

Figure 2:
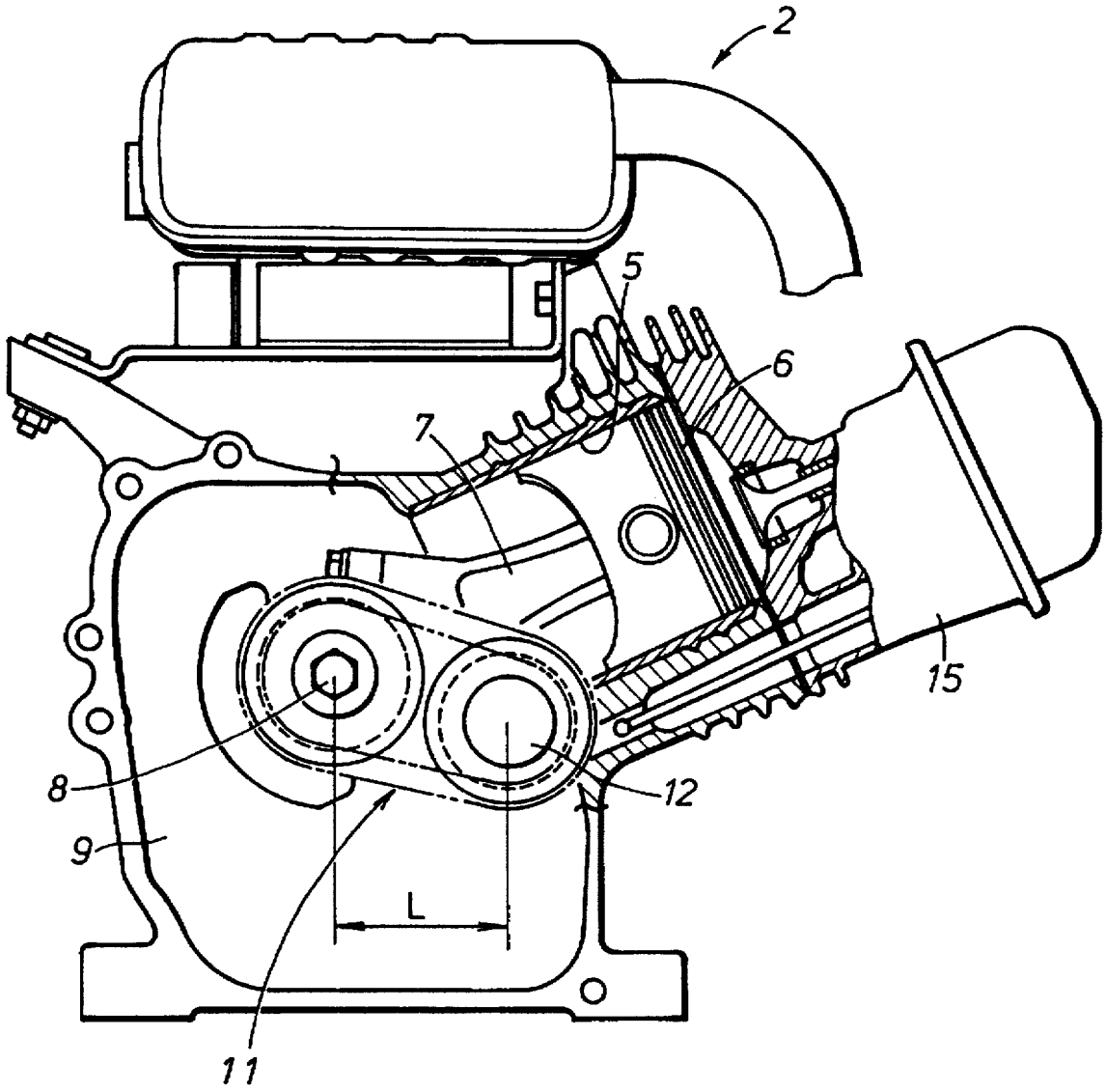
FIG. 2 is a fragmentary sectional view of the internal combustion engine incorporated in the rammer.

Referring to FIG. 2, the axial line of the cylinder 5 of the internal combustion engine 2 is inclined laterally from a vertical line. In the illustrated embodiment, the axial line of the cylinder 5 is inclined from the vertical line by approximately 60 degrees. As can be readily appreciated from the disclosure, this angle can range from a small angle to 90 degrees. If desired, it is also possible to set this angle to more than 90 degrees, in theory up to 180 degrees. In the latter case, the internal combustion engine with be in an inverted disposition.

A piston 6 is slidably received in the cylinder 5, and a crankshaft 8 is connected to the piston 6 via a connecting rod 7, in the conventional manner. The crankshaft 8 is rotatably supported by a crankcase 9. The axial center of the crank shaft 8 extends substantially horizontally and towards the operator. Because the engine 2 is slanted sideways, the center of gravity of the engine 2 is offset to the right of the vertical line passing through the center of the crankshaft 8. To avoid the overall center of gravity of the rammer from shifting away from the axial center of the rammer main body (as projected on a plane perpendicular to the crankshaft 8), the crankshaft 8 of the engine is offset from the axial center line of the rammer main body 3 by a distance L so as to place the center of gravity of the engine 2 on the axial center line of the rammer main body 3.

Figure 3:
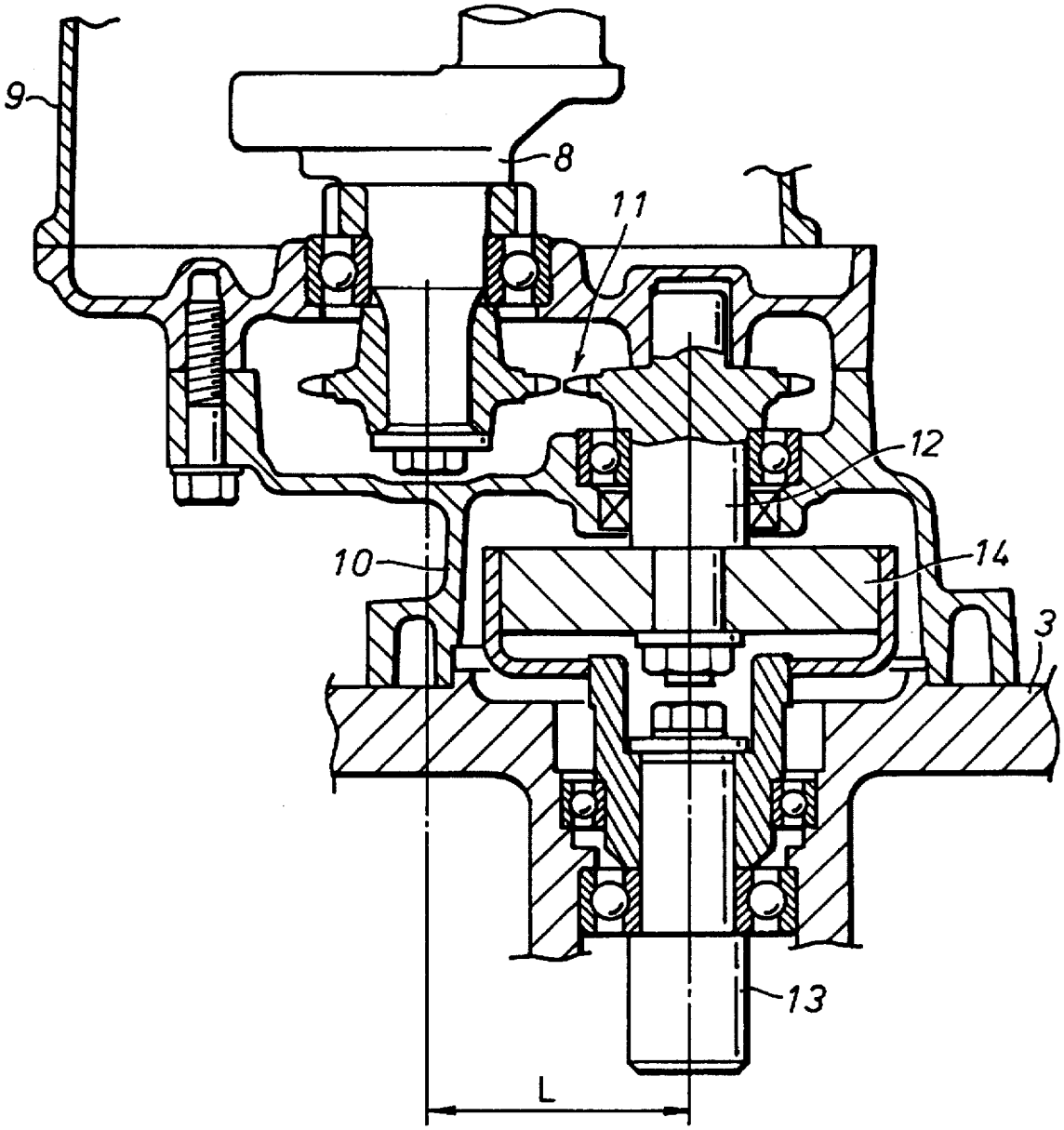
FIG. 3 is a fragmentary sectional view of the power train incorporated in the rammer.

To an end of the crankcase 9 remote from the operator is attached a clutch case 10 as illustrated in FIG. 3. The clutch case 10 accommodates therein a chain-sprocket mechanism 11 which transmits power output from the crankshaft 8 to a power takeout shaft 12 rotatably supported by the crankcase 9 in parallel with the crankshaft 8. As shown in FIG. 2, the chain extends between the two sprockets of the crankshaft 8 and the power takeout shaft 12 to avoid interference between the power takeout shaft 12 and the engine 2. The power takeout shaft 12 is connected to an input shaft 13 of a crank mechanism which is incorporated in the rammer main body 3 via a centrifugal clutch 14 incorporated in the clutch case 10. The input shaft 13 finally transmits power to the stamping plate 4.

The axial center of the power takeout shaft 12 is offset laterally from the axial center of the crankshaft 8 by the distance L toward the cylinder head 15 of the engine 2. More specifically, this distance L is selected such that the axial center of the power takeout shaft 12 is located on the vertically line passing through the center of the gravity of the engine (as projected on a plane perpendicular to the axial center line of the crankshaft 8), and, at the same time, on the axial center line of the rammer main body.

According to the present invention, even though the vertical dimension of the rammer is controlled by slanting the engine sideways, the center of gravity of the engine is kept on the axial center line of the rammer main body. Therefore, a relatively large engine can be used without destroying the balance of the rammer, and the rammer, therefore, would not produce any tendency to tilt during use. Thus, the rammer according to the present invention is easy and comfortable to handle even when a relatively large engine is mounted thereon.

Although the present invention has been described in terms of a specific embodiment thereof, it is possible to modify and alter details thereof without departing from the spirit of the present invention.

What we claim is:

1. A rammer, comprising:

a vertically elongated rammer main body having a stamping plate at a lower end thereof;

a handle bar extending laterally from an upper part of said rammer main body;

an internal combustion engine mounted on an upper part of said rammer main body substantially on a same side as said handle bar, a crankshaft of said engine being within said main body and extending substantially in parallel with said handle bar, and an axial center line of a cylinder of said engine being slanted sideways from a vertical axial line; and a power transmission unit mounted on said rammer main body for transmitting power of said engine to said stamping plate;

wherein a center of gravity of said engine is placed substantially on a vertical line passing through a center of an axial center line of said rammer main body as projected on a plane perpendicular to said handle bar and said crankshaft is offset laterally from said vertical line.

2. A rammer comprising:

a vertically elongated rammer main body having a stamping plate at a lower end thereof;

a handle bar extending laterally from an upper part of said rammer main body;

an internal combustion engine mounted on an upper part of said rammer main body substantially on a same side as said handle bar, a crankshaft of said engine extending substantially in parallel with said handle bar, and an axial center line of a cylinder of said engine being slanted sideways from a vertical axial line;

a power transmission unit mounted on said rammer main body for transmitting power of said engine to said stamping plate;

wherein a center of gravity of said engine is placed substantially on a vertical line passing through a center of an axial center line of said rammer main body as projected on a plane perpendicular to said handle bar; and wherein said power transmission unit comprises a power takeout shaft having an axial line which extends in parallel with said crankshaft and intersects with said vertical line, said power takeout shaft being connected to said stamping plate in a power transmitting relationship.

* * * * *